United States Patent [19]

Kirson et al.

[11] Patent Number: 4,885,977

[45] Date of Patent: Dec. 12, 1989

[54] STABILIZED LINE-OF-SIGHT AIMING SYSTEM FOR USE WITH FIRE CONTROL SYSTEMS

[75] Inventors: Yoram Kirson; Itsak Marom, both of Haifa, Israel

[73] Assignee: State of Israel-Ministry of Defence Armament Development Authority, Haifa, Israel

[21] Appl. No.: 141,318

[22] Filed: Jan. 6, 1988

[30] Foreign Application Priority Data

Jan. 7, 1987 [IL] Israel ..... 81192

[51] Int. Cl.[4] ..... F41G 5/16

[52] U.S. Cl. ..... 89/41.05; 89/41.09; 89/41.17

[58] Field of Search ..... 33/236; 89/41.05, 41.09, 89/41.17; 250/231 GY; 350/500; 358/108, 222

[56] References Cited

U.S. PATENT DOCUMENTS

| | | | |
|---|---|---|---|
| 2,359,032 | 9/1944 | Gott | 89/41.05 |
| 3,518,372 | 6/1970 | Johns | 358/222 |
| 3,659,494 | 5/1972 | Philbrick et al. | 89/41.17 |
| 3,915,019 | 10/1975 | Zoltan | 250/231 GY |
| 4,574,685 | 3/1986 | Sanborn et al. | 89/41.05 |

*Primary Examiner*—Stephen C. Bentley

*Attorney, Agent, or Firm*—Michael N. Meller

[57] ABSTRACT

A fire control system for gunnery weapons having a powered gun positioning system, a stabilized line-of-sight aiming system comprising: housing apparatus having a fixed orientation with respect to the gun boresight; stabilized electro-optical system apparatus for viewing a target along a stabilized line-of-sight, the stabilized electro-optical system apparatus being contained within the housing apparatus; and apparatus for sensing the azimuth and elevation angles of the line-of-sight relative to the housing apparatus, the sensed angles being provided to the gun positioning system for complete position determination of the gun relative to the stabilized line-of-sight.

12 Claims, 3 Drawing Sheets

STABILIZED LINE-OF-SIGHT AIMING SYSTEM FOR USE WITH FIRE CONTROL SYSTEMS

FIELD OF THE INVENTION

The present invention relates to automatic fire control systems for gunnery weapons, more particularly, to a stabilized line-of-sight aiming system forming part of a fire control system for use with mobile armaments capable of firing on the move.

BACKGROUND OF THE INVENTION

Modern fire control systems contain components which form one of the following three categories of subsystems: the aiming system, the fire control computer, and the sensors. The aiming system performs the task of precisely establishing the ballistic angles of elevation and azimuth for the boresight of a gunnery weapon such as a tank relative to the line of sight to the target.

The ballistic angles are computed by a fire control computer in accordance with information which it receives from the gunner and from the various sensors installed on the tank. They depend on the type of projectile being fired, range to the target, wind direction, relative velocity between the tank and the target, and other factors.

The quality of the fire control systems currently available is primarily dependent on the precision of the aiming systems in static firing, that is, where a stationary tank is firing upon a stationary target. Improved fire control systems coming into use allow for firing on the move, and also against moving targets. These systems are very costly, as exemplified by the systems found on the American M1 tank and German Leopard 2 tank.

The firing capability on the move is obtained by the use of aiming systems providing a stabilized line-of-sight. Stabilization of the light of sight permits the gunner to observe a steady and clear landscape without disturbance from rolling and dipping due to motion, to identify the target, to aim at the target with high precision, and to accomplish firing with a high hit probability. Addition of autotracking to these systems further expands their capabilities as it enables precision aiming at moving targets, such as helicopters, despite rapid shifting of the line of sight.

Existing technology in the area of stabilized sights uses biaxial deflection of the head mirror of the gunner's sight in relation to the body of the sight which is rigidly attached to the tank turret. Control of this deflection is achieved by a biaxial platform located in the sight and inertially stabilized with the aid of rate sensors.

The angles of elevation and azimuth of the tank gun relative to the line of sight are measured by three precision angular sensors. One of these is located on the gun trunnion and measures the elevation of the gun relative to the turret. The other two are located in the sight and measure the elevation and azimuth angles of the line-of-sight through the gunner's sight relative to the turret.

The line-of-sight is independently stabilized and is under the control of the gunner. The gun is slaved to the line-of-sight through its servo positioning loops by the determined ballistic angles which are newly defined for each shot by the fire control computer. The servo positioning loops are closed by the three angular sensors.

Because of the high inertia of the gun, it cannot be slaved to the stabilized line-of-sight with sufficient precision to accomplish firing. Thus, the firing is achieved by a technique in which control of firing by the gunner is accomplished only when the actual angle of the gun approaches the calculated ballistic angle within a predetermined zone. That is, the gunner's trigger command is inhibited until the boresight angle is within a predetermined "window". This technique limits the ultimate accuracy of such fire control systems.

SUMMARY OF THE INVENTION

It is accordingly a principal object of the invention to enhance firing accuracy and provide a stabilized line-of-sight aiming system for use with the fire control system on gunnery weapons such as a tank. The aiming system of the present invention is adaptable to many types of fire control systems to provide improved capabilities for firing on moving targets while the weapon itself is stationary or on the move.

According to the invention, there is provided in a fire control system for gunnery weapons having a powered gun positioning system, a stabilized line-of-sight aiming system comprising:

housing apparatus having a fixed orientation with respect to the gun boresight;

stabilized electro-optical system apparatus for viewing a target along a stabilized line-of-sight, the stabilized electro-optical system apparatus being contained within the housing apparatus; and apparatus for sensing the azimuth and elevation angles of the line-of-sight relative to the housing apparatus, the sensed angles being provided to the gun positioning system for complete position determination of the gun relative to the stabilized line-of-sight.

In a preferred embodiment, the aiming system line-of-sight stabilization is based on the use of a free gyro construction. The aiming system housing is mounted directly on the tank gun mantlet so as to move together with the gun as to the azimuth and elevation of the latter. Thus, the aiming system has a fixed orientation with respect to the gun boresight and movement of the gun from one angular position to another will directly provide motion of the aiming system housing to the same extent.

The direction of the stabilized line-of-sight in relation to the aiming system housing is measured by two precision angular sensors, one for azimuth and one for elevation, located inside the aiming system. The measurement is based on electro-optical information obtained from a black-and-white tracing pattern appearing on the rotor of the free gyro, which information is then converted into digital signals which can be processed by a computer.

The slaving of the gun to the line-of-sight and the process of inhibiting the gunner's trigger command until it is within a "window" is similar to that used by the prior art as described above. However, there are at least two important differences, the first being the provision of the aiming system as a rigid sight constructed so as to withstand the high level of firing shocks, making it directly mountable on the gun mantlet. This eliminates the need for a third angular sensor on the gun trunnion, since the two angular sensors together provide complete position determination. The second is the use of electro-optical angular measurement and computation of the line-of-sight with the necessary precision for a fire control system.

Additionally in accordance with the preferred embodiment, an autotracker is provided to measure the angular velocity of the line-of-sight when firing on the move and on moving targets.

Still further in accordance with the preferred embodiment, a day/night viewing system is provided.

In an alternative embodiment, the aiming system housing is directly mounted on the barrel of the gun itself.

In still another alternative embodiment, the line-of-sight stabilization is carried out by rate sensors.

Additional features of the invention will become apparent from the drawings and the description contained hereinbelow.

BRIEF DESCRIPTION OF THE DRAWINGS

For a better understanding of the invention with regard to the embodiments thereof, reference is made to the accompanying drawings, in which.

DETAILED DESCRIPTION OF A PREFERRED EMBODIMENT

Figure 1:
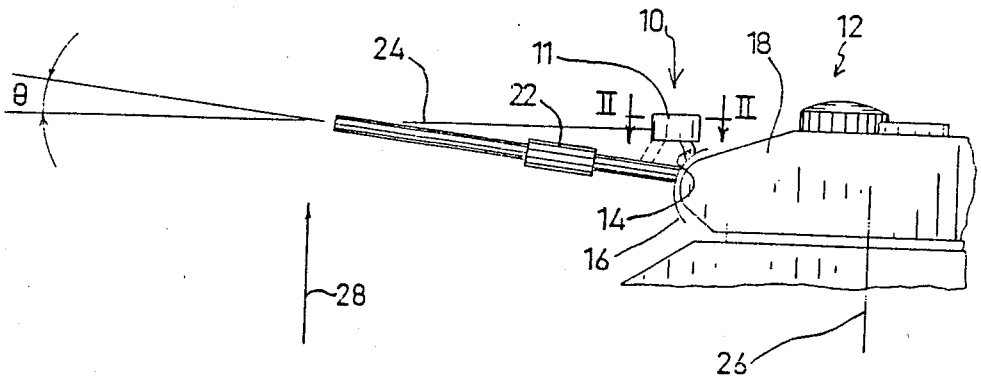
FIG. 1 is a partial elevation of the stabilized line-of-sight aiming system of the present invention mounted on a gunnery weapon.

Turning now to FIG. 1, there is shown a partial elevation of the stabilized line-of-sight aiming system 10 of the present invention mounted on a gunnery weapon, such as a tank shown generally at 12. Aiming system housing 11 is supported by mounting brace 14 which is rigidly affixed to the gun mantlet 16 of the tank turret 18. Gun mntlet 16 acts as a shield for turret 18 and provides a support for the gun barrel 22 of tank 12. The aiming system 10 provides the tank gunner with a stabilized line-of-sight 24 to the target, and this visual information is utilized in association with a fire control system (not shown) which the gunner operates.

Unlike the prior art of stabilized line-of-sight aiming systems, the aiming system housing 11 is mounted directly on the tank gun mantlet 16 as shown in FIG. 1 so as to move together with the gun 22 as to the azimuth (axis 26) and elevation (arrow 28) of the latter. Thus, when the gun positioning system (not shown) causes the gun 22 to move from one angular position to another, the aiming system housing 11 will be moved to the same extent. However, in accordance with the principles of the invention, the mounting can be directly on the gun 22 barrel or in such other way that motion of the gun boresight directly affects the orientation of the aiming system housing 11. The housing 11 itself and the construction of the component parts of the aiming system 10 are manufactured for high shock withstand capability.

In general terms of operation, the gun 22 is continuously slaved to the motion of the line of sight 24 by the gun positioning system. Once the target has been detected and locked upon by the stabilized line-of-sight aiming system 10 of the invention, a firing sequence commences. This is accomplished in three steps: first, the fire control computer finds the required ballistic compensation angles of elevation ($\theta$) and azimuth; second, these angles are fed to the gun positioning system for slaving the gun accordingly; third, the gunner initiates a firing signal by depressing the first button. The firing signal itself is inhibited until gun 22 is actually positioned in accordance with a "window" calculation made by the fire control system, similar to the calculation known from the prior art.

However, in accordance with the principles of the present invention, the stabilized line-of-sight aiming system 10 enables the "window" calculation to be performed in a fashion different from that of the prior art in at least two ways. First, measurement of the direction of line-of-sight 24 in relation to system housing 11 is derived from two precision angular sensors, one for azimuth and one for elevation, each located inside the stabilized line-of-sight aiming system housing 11. By virtue of direct mounting which fixes the orientation of the aiming system housing 11 with respect to the gun boresight, the angle of the gun 22 with respect to the turret 18 is no longer needed. Second, the measurement is based on electro-optical information obtained from a black-and-white tracing line pattern appearing on the rotor of the free gyro, which information is then converted into digital signals which can be processed by a computer.

The first of these differences, direct mounting, enables the elimination of the angular sensor commonly used at the gun trunnion in the prior art, since the two precision angular sensors in system housing 11 provide complete position determination. The second difference, electro-optical angular measurement, allows for the achievement of the necessary level of precision when gun 22 is slaved to line-of-sight 24 in the operation of the fire control system.

Figure 2:
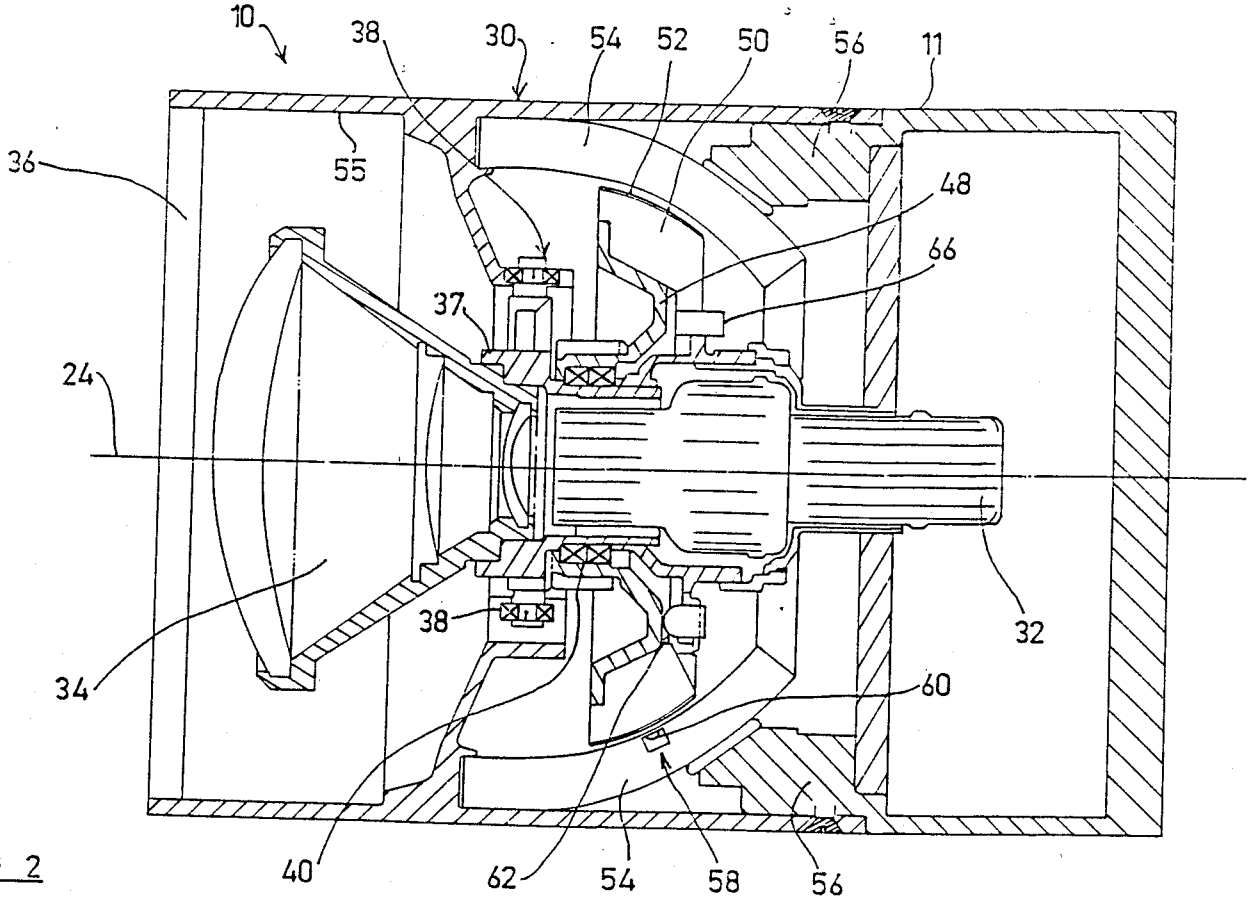
FIG. 2 is a cross-section taken along line II—II of FIG. 1 showing a free gyro electro-optical construction used in the stabilized line-of-sight aiming system of the present invention.

Referring now to FIG. 2, there is shown a cross-section taken along line II—II of FIG. 1, featuring a free gyro electro-optical construction 30 of stabilized line-of-sight aiming system 10. Free gyro construction 30 provides stabilization of line-of-sight 24 so as to increase the gunner's ability to engage targets while on the move or to fire upon moving targets while stationary. Line-of-sight 24 is defined by an image sensor 32 forming part of an electro-optical viewing system, such as a closed-circuit television scanning system in accordance with known techniques.

Image sensor 32 includes an integral lens assembly 34 which faces an end of system housing 11 enclosed by a window 36 through which passes the reflected light of a target (not shown). Image sensor 32 is supported in system housing 11 by a bracket 37 whose orientation in space is determined by a combination of two pairs of gimbal bearings 38 arranged as a mounting providing two degrees of freedom.

Spin bearings 40 are seated in bracket 37 about which a rotor 48 is freely rotatable. The rotor construction includes a magnetized ring 50, the outer peripheral edge 52 of which is inscribed with a tracing line pattern providing angular position information as further described herein. Rotor 48 rotates within a surrounding stator coil assembly 54 which is rigidly mounted in wall 55 and held by braces 56.

A notch 58 in coil assembly 54 provides a mounting location for an electro-optical position detector 60 which faces the tracing line pattern inscribed on edge 52 of magnetized ring 50. Another position detector (not shown) is mounted similarly at another point in coil assembly 54. A commutation pick-up 62 is fixed in bracket 37 and is associated with speed detection of rotor 48.

In operation, energization of one section of coil assembly 54 is such as to set up a rotating magnetic field. Magnetized ring 50 is designed to be a permanent magnet, producing rotor 48 rotation about an axis of rotation designed to be coincident with line-of-sight 24. This achieves free gyro stabilization of line-of-sight 24. Unwanted angular disturbances of a periodic nature in line-of-sight 24 are minimized by the provision of nutation damper 66 as part of the structure of bracket 37. Energization of another section of coil assembly 54 is such as to exert a precession torque on magnetized ring 50, thereby achieving controlled deflection of line-of-sight 24.

As mentioned earlier, the aiming system of the present invention eliminates the need for one of the three angular sensors common to prior art systems by direct mounting of system housing 11 on gun mantlet 16. The other angles relative to line-of-sight 24 are elevation and azimuth, and these can be measured by the electro-optical position detectors. Position detector 60 can be designed as a LED and light sensor combination, with the light generated by the LED being reflected from the rotating tracing line pattern on edge 52 of magnetized ring 50 onto the light sensor. The tracing line pattern can be chosen to give angular position information in digital form, for example by use of a black-and-white sloped line pattern which intersects the tracing line of the light sensor at different points depending on angular position. The presence or absence of the reflection determines the state of the input to the information processor. This technique is known generally in the prior art in connection with the construction of missile seekers.

Based on the angular position information provided by the tracing line pattern and position detector 60, the fire control system computer can calculate the necessary motion of gun 22 to achieve alignment with line-of-sight 24 before the firing command is permitted to initiate an actual firing.

An alternative to the free gyro construction 30 of FIG. 2 would be to incorporate a rate sensor stabilization technique in the aiming system 10 of the present invention. However, this approach would be more costly and for this reason is not as desirable.

Figure 3:
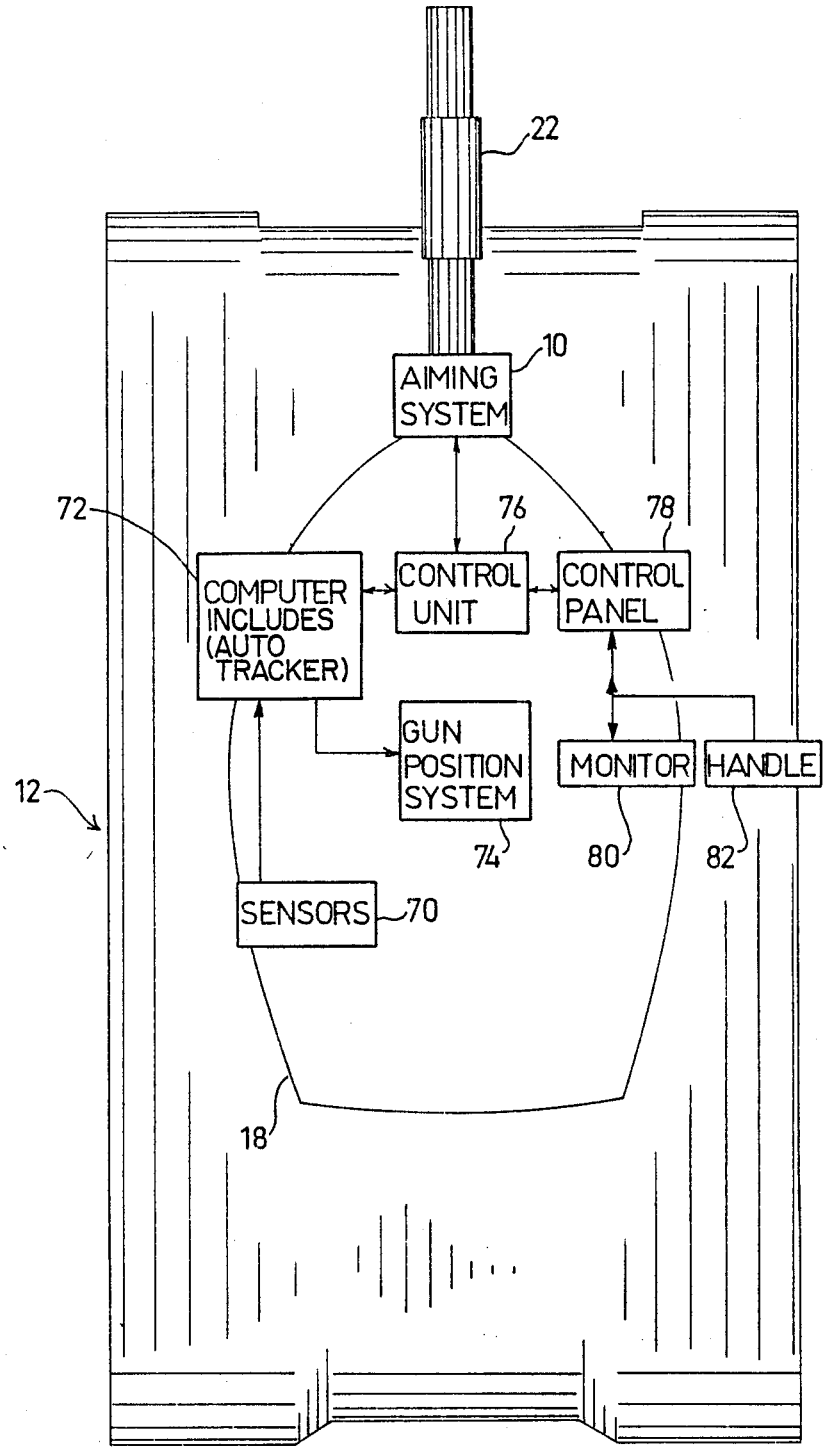
FIG. 3 is a block diagram of a fire control system incorporating the stabilized line-of-sight aiming system of the present invention.

Referring now to FIG. 3, there is shown a block diagram of a fire control system incorporating the stabilized line-of-sight aiming system 10 of the present invention. For illustrative purposes only, the block diagram layout is superimposed on a top view of the body of tank 12 and turret 18. The sensors 70 provide input data such as range, temperature, wind velocity and direction, ground slope of tank position, gun position and other environmental firing conditions to fire control computer 72 for calculation of the ballistic compensation angles as described earlier. The gun positioning system 74 includes the power source and servomotor position loops for controlling the movement of gun barrel 22 relaive to the tank 12 body.

The control unit 76 provides control of stabilized line-of-sight aiming system 10 by furnishing it with power and conducting the transfer of information signals from aiming system 10 to fire control computer 72. As mentioned earlier, aiming system 10 is mounted in fixed orientation with respect to gun barrel 22. When fire control computer 72 computes the ballistic angles, these computed angles are compared therein with existing gun position angles to develop position feedback for gun positioning system 74.

A control panel 78 provides for selection of projectile type by the gunner and other manual data input, which information is communicated to fire control computer 72 via control unit 76. Control panel 78 also provides connection of a monitor 80 forming part of the closed-circuit TV system for viewing the target through image sensor 32 of aiming system 10. A switch on gunner handle 82 enables operation of aiming system 10 in manual or automatic modes. The manual mode is operative with gunner handle 82 to allow slewing of image sensor 32 for controlled deflection of line of sight 24 as described previously in connection with FIG. 2. Gunner handle 82 also allows for switching to the automatic mode by locking aiming system 10 on the target as part of an autotracker function which also measures the angular velocity of line-of-sight 24 when firing on the move and on moving targets.

While the principles of the invention have been described with regard to particular embodiments, it is to be understood that the description is made by way of example only and not as a limitation on the scope of the invention, which is set forth in the appended claims.

We claim:

1. In a fire control system for gunnery weapons having a powered gun positioning system and including a gun barrel having a boresight, a stabilized line-of-sight aiming system comprising:

stabilized electro-optical means for viewing a target along a stabilized line-of-sight, said stabilized electro-optical means being fixedly supported with respect to said boresight;

means for sensing the azimuth and elevation angles of said line-of-sight relative to said boresight; and means for slaving said gun barrel in accordance with said line-of-sight by employing the azimuth and elevation angles measured by said means for sensing.

2. The aiming system of claim 1 wherein said stabilized electro-optical means is rigidly mounted directly on a tank gun mantlet.

3. The aiming system of claim 1 wherein said stabilized electro-optical means is directly mounted on the gun barrel.

4. The aiming system of claim 1 wherein the line-of-sight is stabilized by free gyro stabilization.

5. The system of claim 4 wherein said means for sensing the direction of the line-of-sight in relation to said boresight comprises two precision angular sensors, one for azimuth and one for elevation.

6. The aiming system of claim 1 wherein said stabilized electro-optical means includes a day/night viewing system.

7. The aiming system of claim 1 wherein said stabilized electro-optical means includes an autotracker to facilitate aiming and to measure the angular velocity of the line-of-sight when firing on the move and on moving targets.

8. In a fire control system for gunnery weapons having a powered gun positioning system and including a gun barrel having a boresight, a method of determining the gun position relative to a stabilized line-of-sight, said method comprising the steps of:

fixedly supporting stabilized electro-optical means for viewing a target along a stabilzed line-of-sight with respect to said boresight;

sensing the azimuth and elevation angles of said stabilized line-of-sight relative to the gun boresight; and slaving the gun barrel in accordance with the orientation of said line-of-sight by employing the azimuth and elevation angles measured by said means for sensing.

9. The method of claim 8 wherein said system means is rigidly mounted directly on a tank gun mantlet.

10. The method of claim 8 wherein said system means is directly mounted on the gun barrel.

11. The method of claim 8 wherein the line-of-sight is stabilized by free gyro stabilization.

12. The method of claim 8, further comprising the step of operating an autotracker to facilitate aiming and to measure the angular velocity of the line-of-sight when firing on the move and on moving targets.

* * * * *